US007247059B2

(12) United States Patent
Greaves

(10) Patent No.: US 7,247,059 B2
(45) Date of Patent: Jul. 24, 2007

(54) ELECTRICAL CONNECTOR WITH ADAPTOR FOR CONVERTING ONE OR MORE OPENINGS TO MOUNTABLE OPENINGS

(76) Inventor: Christopher G. Greaves, 19 Seaview Ave., Madison, CT (US) 06443

( * ) Notice: Subject to any disclaimer, the term of this patent is extended or adjusted under 35 U.S.C. 154(b) by 53 days.

(21) Appl. No.: 11/062,216

(22) Filed: Feb. 17, 2005

(65) Prior Publication Data

US 2005/0191893 A1 Sep. 1, 2005

Related U.S. Application Data

(63) Continuation-in-part of application No. 10/874,530, filed on Jun. 23, 2004, now abandoned.

(60) Provisional application No. 60/480,848, filed on Jun. 23, 2003.

(51) Int. Cl.
*H01R 9/22* (2006.01)

(52) U.S. Cl. ..... 439/709

(58) Field of Classification Search ..... 439/723, 439/798, 724, 564, 573, 572; 411/546, 338, 411/339

See application file for complete search history.

(56) References Cited

U.S. PATENT DOCUMENTS

| | | | | |
|---|---|---|---|---|
| 4,456,326 | A | 6/1984 | Sauber | |
| 4,983,132 | A | 1/1991 | Weidler | |
| 5,209,621 | A * | 5/1993 | Burbidge | 411/340 |
| 5,848,913 | A | 12/1998 | Ashcraft | |
| 5,921,793 | A | 7/1999 | Phillips | |
| 6,343,943 | B1 | 2/2002 | Shen | |
| 6,391,096 | B1 * | 5/2002 | Waters et al. | 96/6 |

* cited by examiner

*Primary Examiner*—Briggitte R. Hammond
(74) *Attorney, Agent, or Firm*—Bachman & LaPointe, P.C.

(57) ABSTRACT

A method for converting an electrical connector to provide an insulated opening, including the steps of providing an electrical connector including a conductive block having at least one cavity having an upwardly oriented opening and a closed bottom, and an insulating outer coating at least partially surrounding the block, forming a hole through the bottom, and positioning an insulative sleeve through the cavity and the hole so as to provide an insulated passage extending through the electrical connector.

18 Claims, 3 Drawing Sheets

ELECTRICAL CONNECTOR WITH ADAPTOR FOR CONVERTING ONE OR MORE OPENINGS TO MOUNTABLE OPENINGS

CROSS-REFERENCE TO RELATED APPLICATION

This application is a Continuation-In-Part of U.S. patent application Ser. No. 10/874,530, filed Jun. 23, 2004 now abandoned, which claims the benefit of U.S. Provisional Application Ser. No. 60/480,848, filed Jun. 23, 2003.

BACKGROUND OF THE INVENTION

Electrical or power connectors are known for connecting various different conductive elements, and FIG. 1 shows a cross-sectional view of a conventional connector of the type in question. Connector 10 includes a conductive block 12 having a series of contact channels 14 each of which opens upwardly through a threaded opening as shown, and also opens towards the front of the device and the rear of the device as schematically illustrated by dashed lines 16. An insulative coating or jacket 20 is positioned around block 12.

In use, elements are passed into the front or back openings illustrated by dashed circles 16, and a threaded member is screwed down through the upward opening into threads 18 so as to frictionally engage a member passed through front or back openings 16 as desired. In this manner, conductive elements can be electrically connected through fastening in connector 10.

It is sometimes desirable to mount a device such as device 10 to a secure or otherwise rigid location and the like. In such instances, the most convenient form of mounting would be to use mechanical fasteners. However, device 10 does not lend itself well to such mounting, and therefore completely separate and different devices are provided having structure included for mounting of the device. Unfortunately, this leads to excessive amounts of required inventory, as well as multiple parts and other disadvantages.

It is the primary object of the present invention to provide an electrical connector which can readily and advantageously be converted to have one or more mountable openings.

It is a further object of the present invention to provide such a device whereby conversion is a simple and easily accomplished task.

It is a still further object of the present invention to provide an adaptor member for use in converting an electrical connector, as well as a process for converting an electrical connector, each of which presents the advantageous features of the present invention.

Other objects and advantages of the present invention will appear hereinbelow.

SUMMARY OF THE INVENTION

In accordance with the present invention, a method for converting an electrical connector to provide an insulated opening, comprises the steps of providing an electrical connector comprising a conductive block having at least one cavity having an upwardly oriented opening and a closed bottom, and an insulating outer coating at least partially surrounding the block, forming a hole through the bottom, and positioning an insulative sleeve through the cavity and the hole so as to provide an insulated passage extending through the electrical connector.

In further accordance with the present invention, an adaptor for an electrical connector comprises a sleeve of insulative material having a central passage for receiving a mechanical connector, the sleeve having a first portion with a first diameter and a second portion with a second diameter which is smaller than the first diameter.

In further accordance with the present invention, an electrical connector having an insulated opening is provided which comprises an electrical connector comprising a conductive block having at least one cavity having an upwardly oriented opening and a bottom, a hole passing through the bottom, an insulating outer coating at least partially surrounding the block, and an insulative sleeve extending through the cavity and the hole so as to provide an insulated passage extending through the electrical connector.

In accordance with a further preferred embodiment of the present invention, the insulative sleeve has a spacer or shoe which extends downwardly beyond a bottom surface of the block and insulative coating thereon. The sleeve can further preferably include a separate flange member which is movably mountable over the sleeve to securely fix the sleeve relative to the block.

BRIEF DESCRIPTION OF THE DRAWINGS

A detailed description of preferred embodiments of the present invention follows, with reference to the attached drawings, wherein.

DETAILED DESCRIPTION

Figure 1:
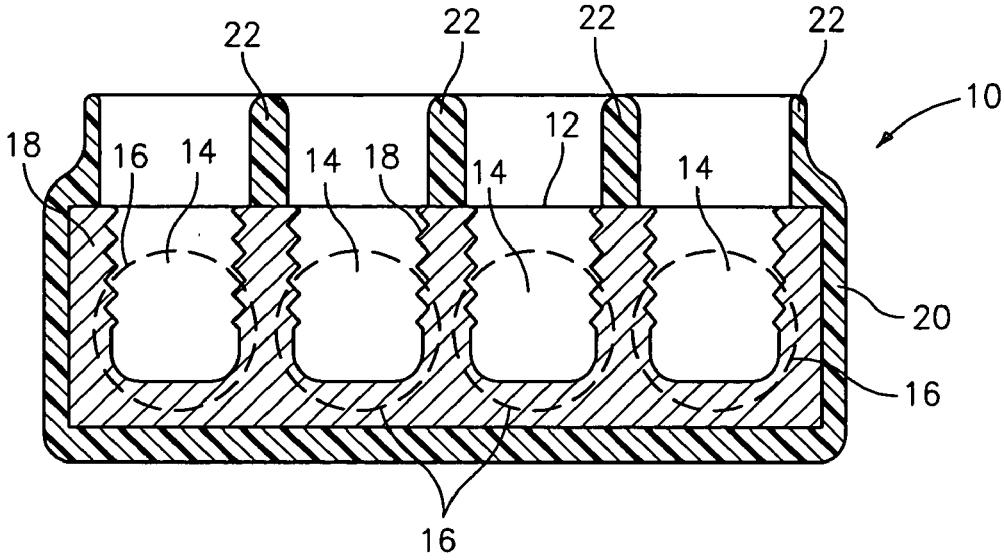
FIG. 1 is a sectional side view of a conventional electrical connector of the type which can be converted in accordance with the present invention.

The invention relates to electrical connectors and, more particularly, to an electrical connector and adaptor which can readily be used to convert one or more connector ports or openings of the connector for use in mounting the connector to an underlying mounting structure.

As described above, FIG. 1 illustrates a typical electrical connector 10 having a conductive block 12 with a series of connection openings 14, each of which opens upwardly as well as to the front and rear of the device. The openings to the front and rear of the device are illustrated by dashed circles 16, and the upwardly opening portion is the opening which has threaded walls 18. Positioned around conductive block 12 is an insulating material 20 which is typically coated or otherwise provided onto block 12 so as to cover the entire exterior surface thereof, and further so as to define upwardly opening sleeves 22 which are aligned with each of the openings 14 in block 12. For openings 14, 16 which are not to be used, a typical insulative plug member can be frictionally fit within the openings defined by sleeves 22. It should be appreciated that insulative coating 20 is further provided so as to define sleeves such as sleeves 22 extending forward and backward from openings 16 as well.

Figure 2:
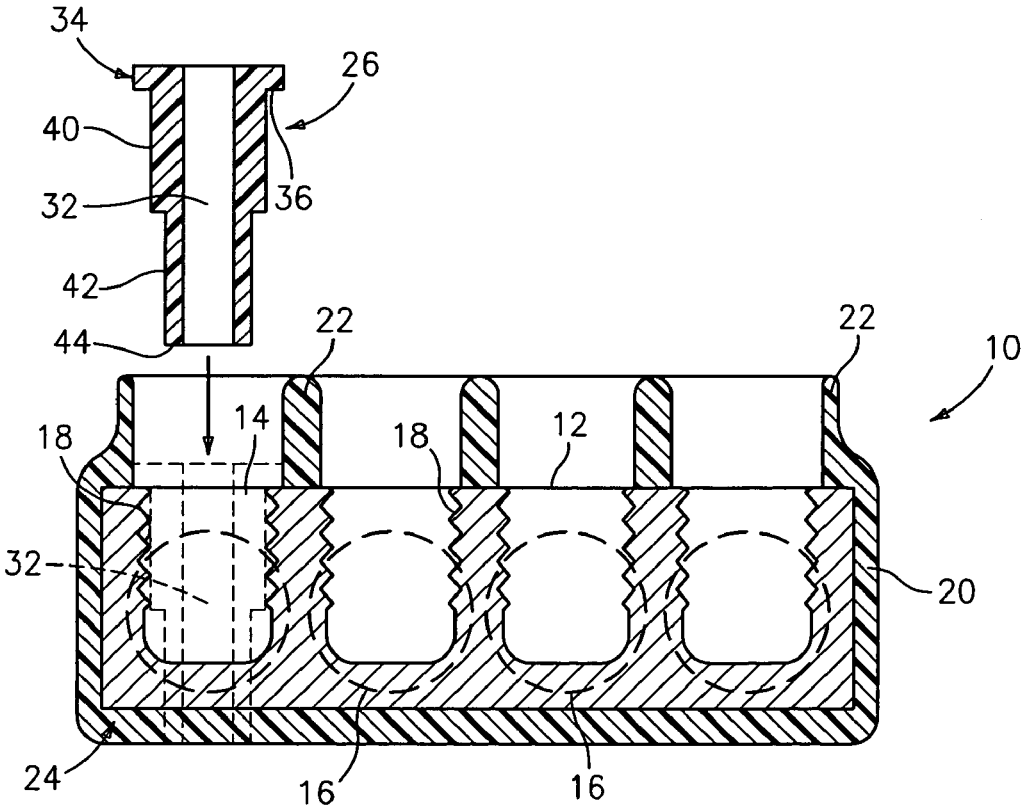
FIG. 2 schematically illustrates a step in connection with conversion of the connector of FIG. 1, as well as an adaptor in accordance with the present invention.

In accordance with the invention, it is frequently desirable to utilize a device 10 which must be secured to an underlying mounting structure or the like. In such instances, conventionally, a new device would need to be designed which would lead to undesirable increase in cost and the amount of inventory. Turning to FIG. 2, the present invention is illustrated wherein an opening 14 of device 10 is converted to an insulated opening which can then be used to mount device 10 to an underlying structure utilizing conductive or conventional mechanical fasteners.

According to the invention, the bottom portion 24 of an opening 14 is drilled out. This hole is drilled through the bottom of conductive block 12 and through the corresponding portion of insulative layer 20, and an insert member 26 is then advantageously disposed within opening 14 and extending through the drilled bottom portion 24. Adaptor or insert member 26 is advantageously provided of an insulative material, and when positioned within opening 14 advantageously serves to provide an opening through which mechanical fasteners can be positioned without risk of contact or conductivity between the mechanical fastener and block 12. Bottom portion 24 is preferably drilled to approximately the same size as adaptor 26.

Adaptor 26 will be further described below, but is advantageously sized and dimensioned for secure force fitting within opening 14.

It should also be appreciated that although FIG. 2 shows adaptor 26 being positioned in one end opening 14 of device 10, it is preferred to position as many adaptors 26 in a device 10 as are necessary to provide secure mounting of device 10 as desired, while nevertheless allowing for the necessary connections to be made through device 10 as well. In this regard, the embodiment shown illustrates a four opening device 10. These electrical connector devices 10 can be provided having a large variety of numbers of openings, and the present invention is equally applicable to other configurations.

It should also be appreciated that while positioning of adaptors 26 in end openings, preferably in the pair of end openings on each end of device 10, can in many instances provide for the most secure mounting of device 10, it may be desirable and is certainly within the scope of the present invention to position adaptors 26 in interior openings either instead or as well.

Figure 3:
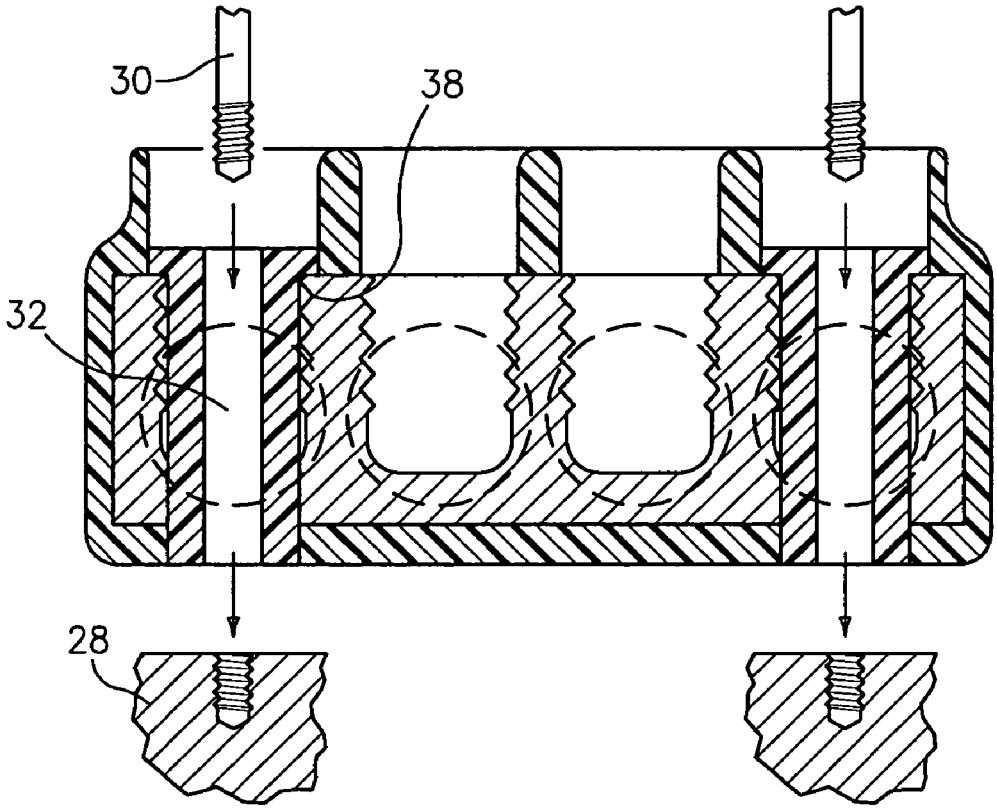
FIG. 3 schematically illustrates a connector which has been converted in accordance with the present invention along with steps for securing the device to an underlying mounting structure.

Turning to FIG. 3, a device 10 is shown in accordance with the present invention with two adaptors 26 mounted therein, on each end opening 14. Device 10 is mounted to underlying structures schematically illustrated at 28 using conventional fasteners 30 which can now be disposed through opening 32 of adaptors 26 and into structures 28 for use in mounting device 10 to structures 28 without risk of electrical communication or connection between fasteners 30 and block 12.

In this regard, adaptors 26 are force fit into device 10, and are preferably sized and adapted to fit snuggly into opening 14. This in itself holds adaptor 26 securely within opening 14. In addition, however, since mechanical fastener 30 will typically have an enlarged head which will pass over the top of adaptor 26, the positioning of mechanical fastener 30 itself will also serve to hold adaptor 26 within opening 14 as desired.

Figure 4:
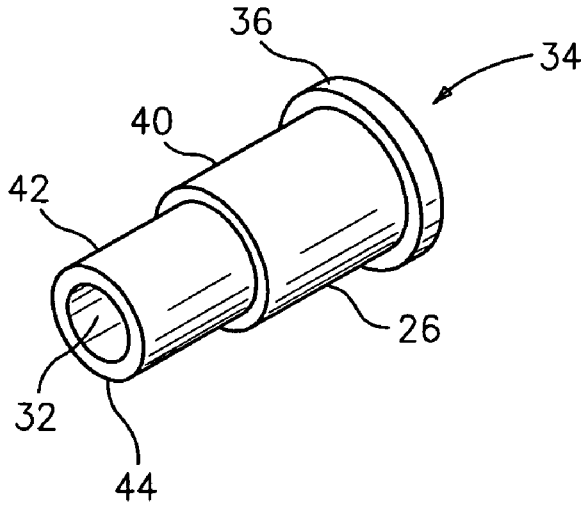
FIG. 4 is a perspective view of an adaptor in accordance with the present invention.

Turning to FIG. 4, adaptor 26 is further illustrated and preferably is a substantially elongate and tubular member having a head portion 34 preferably defining a flange 36 which is sized to extend and overlap over the top edge 38 (FIG. 3) of openings 14. Adaptor 26 also has an intermediate portion 40 which is preferably provided having an outside diameter sized to frictionally engage with threads 18 of opening 14. Adaptor 26 further has a lower portion 42 extending to an edge 44 of adaptor 16 which is sized, preferably, to match the size of the hole to be drilled through drilled bottom portion 24. This preferred embodiment of adaptor 26 advantageously serves to allow for converting an unmountable opening 14 such as is illustrated in FIG. 1 to a mountable opening such as is illustrated in FIG. 3 for use with mechanical fasteners 30 and underlying mounting structures 28 as desired.

As set forth above, adaptors 26 can advantageously be provided from any suitable non-conductive material, many examples of which are well known to a person of ordinary skill in the art.

Further, adaptor 26 is preferably provided having a length from flange portion 36 to edge 44 which substantially corresponds to the length of opening 14 after drilling of drilled portion 24 such that adaptor 26 can be positioned with flange 36 resting on the top surface of block 12, and with bottom edge 44 substantially flush with a bottom surface of insulative coating 20.

It should be appreciated that adaptor 26 as illustrated in FIGS. 2, 3 and 4 is a preferred embodiment, and it is well within the broad scope of the present invention to provide adaptor 26 having a different shape or structure, particularly, a different outer shape or structure, for use in engaging interior portions of opening 14. For example, the stepped down size of adaptor 26 allows for a smaller hole to be drilled through bottom portion 24, which is desirable so as to reduce impact upon the structural strength of the connector. Of course, it is well within the broad scope of the present invention to have an adaptor having a substantially straight outer wall.

It should also be noted that interior opening 32 of adaptor 26 is advantageously sized and dimensioned to receive a typical mechanical fastener, and this dimension can be adjusted as necessary or desired. It is preferable that opening 32 be of a size sufficient to receive the largest of any suitable size mechanical fastener which may be desired for use in connection with mounting device 10 as desired.

It should also be noted that conversion of an opening 14 to a mountable opening in accordance with the present invention and as described above serves to block the front and back opening 16 of device 10 for use in securement of conductive members. Front and back opening 16 for a converted opening 14 are advantageously filled with insulative plug members as described above.

It should further be noted that the drilling of bottom portion 24 is preferably done in a factory setting, where machining tolerances and requirements of uniformity can readily be met, as can regulatory codes for the manufacture of such articles. Of course, it is within the broad scope of the invention to modify a connector by drilling and positioning of an insert in other settings, or even on an as used basis, although in such settings other steps may be needed to ensure conformance of the converted part.

Figure 5:
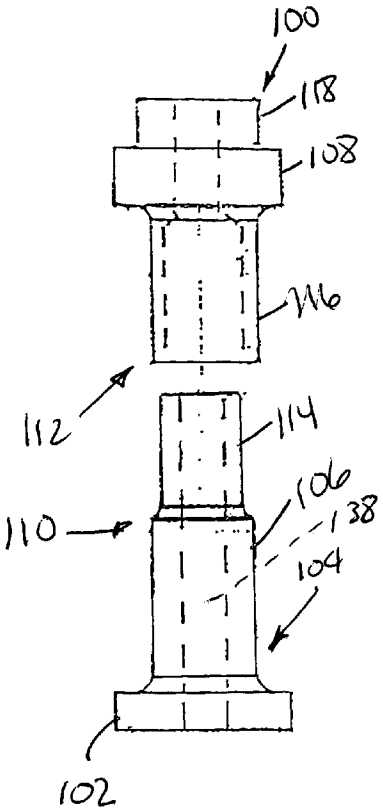
FIG. 5 is an elevational view of an adaptor member in accordance with a preferred embodiment of the present invention.

FIG. 5 shows a sleeve or adaptor 100 in accordance with a preferred embodiment of the present invention. Adaptor 100 advantageously includes a shoe 102 which is positioned at one end 104 of adaptor 100. Shoe 102 extends radially relative to a diameter of the sleeve portion 106 of adaptor 100, and thereby extends radially over a bottom surface of the converted block as will be illustrated in FIG. 6.

Still referring to FIG. 5, adaptor 100 in this embodiment can further advantageously include a sleeve collar 108 which is advantageously positioned and spaced along a longitudinal axis of adaptor 100, relative to shoe 102, which engages against a block which is converted using adaptor 100 so as to firmly secure adaptor 100 relative to the block as desired. In this regard, collar 108 advantageously engages the block. This is also further illustrated in FIG. 6 discussed below.

Still referring to FIG. 5, adaptor 100 in this embodiment is advantageously provided in the form of two sleeve members 110, 112, and shoe 102 is advantageously defined on one member 110, while collar 108 is advantageously defined on the other member 112. Members 110, 112 are further engagable one, relative to the other, for example through telescoping or force fit as in the embodiment of FIG. 5. More specifically, first sleeve portion 110 advantageously has a male or reduced-diameter portion 114, and sleeve portion 112 advantageously has a corresponding female or receiving portion 116 which is sized to receive portion 114 of sleeve portion 110.

As with the embodiment of FIGS. 1-4, adaptor 100 is advantageously adapted to force-fit within the opening in the block, and further to have a force-fit between elements 114 and 116. This advantageously provides for reliable and secure engagement of the elements of adaptor 100, and further of secure engagement of adaptor 100 with the block.

Shoe 102 is advantageous as will be further illustrated in FIG. 6 described below because shoe 102 extends over a bottom surface of the insulated block and serves to space the entire connector assembly from the mounting structure. This advantageously serves to prevent undesirable arcing and/or to prevent spark from jumping between the block and mounting surface, particularly when exposed to rigorous testing conditions and the like.

Still referring to FIG. 5, a sleeve extension 118 can advantageously be provided and extending further upwardly or away from shoe 102 past collar 108. This extending portion 118 advantageously allows the adaptor 100 to be securely engaged by a cap, also as will be discussed below. Extension 118 preferably extends at least about ⅜-7⁄16" past collar 108 for a typical-sized connector, and this length of extension 118 has been found to be advantageous in reliably insulating block 122 from a fastener positioned through adaptor 100.

While the embodiment of FIG. 5 shows elements 110, 112 as telescopingly engagable sleeves, it should be appreciated that the entire length of the sleeve could be defined as a single element, for example extending from shoe 102, and collar 108 could be securable relative to this extended length sleeve. Conversely, the entire sleeve could be mounted relative to collar 108 and movably engagable with shoe 102 as well. Further, elements 110, 112 can be engagable in other ways, for example with threads or other securing structure, well within the broad scope of the invention.

Adaptor 100 in all other respects works in similar fashion to the adaptor discussed in connection with FIGS. 1-4 and provides an insulative opening through the block for use in mounting the block to an underlying structure with a conventional fastener such as a bolt.

Figure 6:
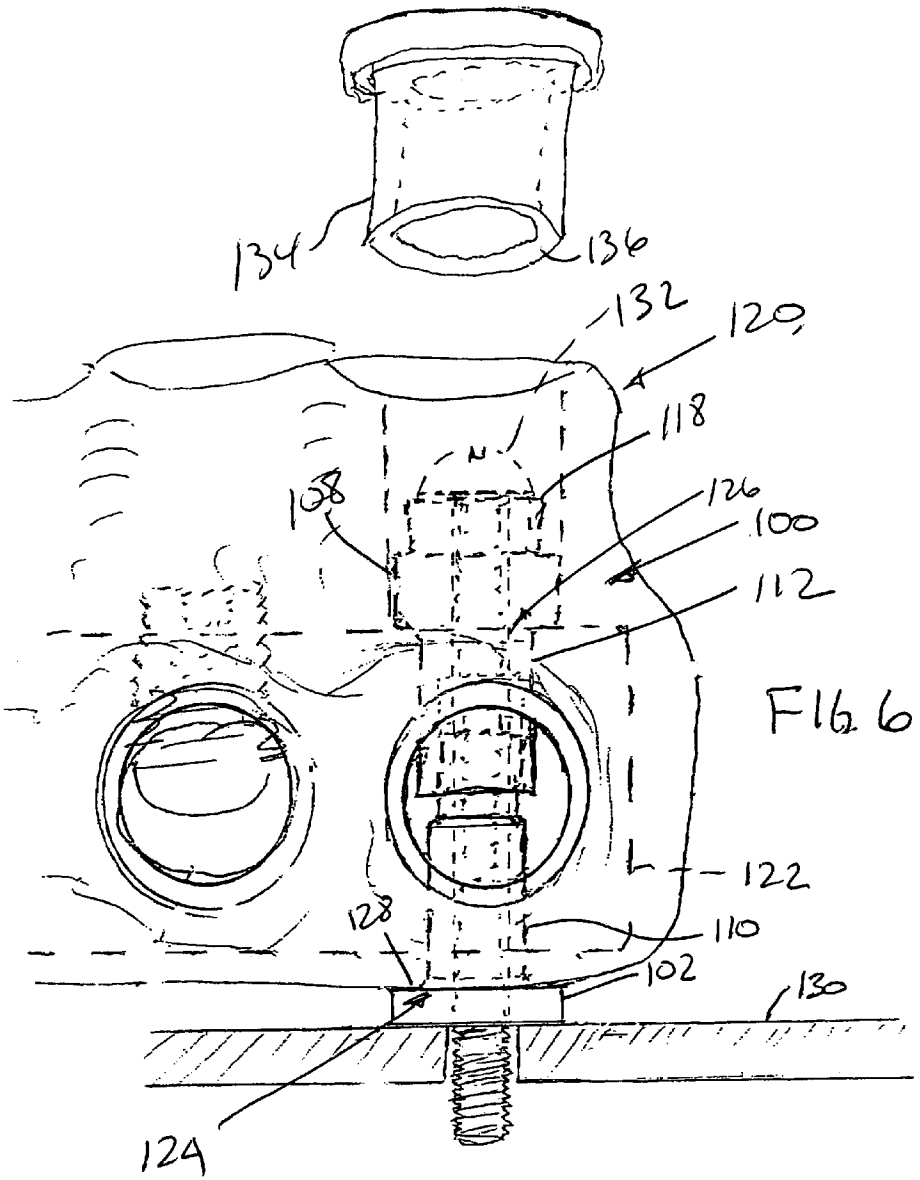
FIG. 6 is a side view of an electrical connector with the adaptor of FIG. 5.

Turning now to FIG. 6, a connector assembly 120 is illustrated which includes an adaptor 100 in accordance with the present invention which is positioned within a block 122 which has been drilled to provide a hole passing therethrough in similar fashion to the embodiment of FIGS. 1-4. As shown, first sleeve portion 110 is positioned into this opening through a bottom opening 124 in block 122, and second sleeve portion 112 is positioned into the opening from the upper opening 126 in block 122. Portions 114, 116 of adaptor 100 are slidably engaged as shown, with sleeve collar 108 engaging an upper portion of block 122 and with shoe 102 extending over a bottom surface 128 of the insulative coating surrounding block 122. As shown, shoe 102 advantageously serves to define or provide a gap between bottom surface 128 and the underlying mounting surface 130 as desired.

A fastener 132 is shown positioned through adaptor 100 and into mounting surface 130, which advantageously results in mounting of connector assembly 120 relative to mounting surface 130 as desired.

After securing connector 132 as shown, a cap 134 can advantageously be positioned over the head of connector 132 and have an extending sleeve member 136 which is slidably engaged with sleeve extension 118 as discussed above.

The provision of shoe 102 and collar 108 advantageously serves to insure against arcing and other undesirable result when particularly large voltages are passed through the connector. This can be particularly helpful when subjected to conditions such as those required for UI rating.

It should be appreciated that adaptor 100 can advantageously be provided from any suitable material which is sufficiently insulative, and preferably which allows for a good force fit relative to block 122 and between the elements 110, 112 thereof. For example, these elements can be made of nylon as one non-limiting example.

Referring to both FIGS. 5 and 6 together, and in similar fashion to the embodiments of FIGS. 1-4, adaptor 100 has an internal passage 138 which in this embodiment extends from shoe 102 along first portion 110 and including portion 114, and which then continues in second portion 112, and this embodiment from the top of portion 116 through collar 108 and sleeve extension 118. When first and second portions 110, 112 are assembled, this passage 138 extends continuously through the entire adaptor 100 for receiving a connector as shown in FIG. 6 and as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope.

What is claimed is:

1. A method for converting an electrical connector to provide an insulated opening, comprising the steps of:

providing an electrical connector comprising a conductive block having at least one cavity having an upwardly oriented opening and a closed bottom, and an insulating outer coating at least partially surrounding the block;

forming a hole through the bottom; and positioning an insulative sleeve through the cavity and the hole so as to provide an insulated passage extending through the electrical connector, wherein the insulative sleeve further comprises a shoe positioned to extend radially over a bottom surface of the insulating outer coating of the block.

2. The method of claim 1, wherein the insulative sleeve is friction fit in the cavity and the hole.

3. The method of claim 1, further comprising the step of mounting the electrical connector to an underlying structure by positioning a fastener through the insulative sleeve and into engagement relative to the underlying structure.

4. The method of claim 1, wherein the cavity has at least one laterally extending opening.

5. The method of claim 1, further comprising a sleeve collar spaced from the shoe and positioned to engage the block and secure the sleeve relative to the block.

6. The method of claim 5, wherein the insulative sleeve has a longitudinal axis, and wherein the sleeve collar is positionable along the sleeve relative to the shoe.

7. The method of claim 5, wherein the sleeve comprises a first sleeve portion and a second sleeve portion, wherein the shoe is defined on the first sleeve portion and the sleeve collar is defined on the second sleeve portion, and wherein the first sleeve portion and the second sleeve portion are engagable with each other.

8. The method of claim 7, wherein the first sleeve portion and the second sleeve portion telescopingly engage each other.

9. The method of claim 5, further comprising a sleeve extension extending upwardly past the sleeve collar.

10. The method of claim 9, further comprising positioning a cap over and engaging with the sleeve extension.

11. An electrical connector having an insulated opening, comprising:

an electrical connector comprising a conductive block having at least one cavity having an upwardly oriented opening and a bottom, a hole passing through the bottom;

an insulating outer coating at least partially surrounding the block; and an insulative sleeve extending through the cavity and the hole so as to provide an insulated passage extending through the electrical connector, wherein the insulative sleeve further comprises a shoe positioned to extend radially over a bottom surface of the insulating outer coating of the block.

12. The apparatus of claim 11, wherein the cavity further comprises laterally extending opening.

13. The apparatus of claim 11, further comprising a sleeve collar spaced from the shoe and positioned to engage the block and secure the sleeve relative to the block.

14. The apparatus of claim 13, wherein the insulative sleeve has a longitudinal axis, and wherein the sleeve collar is positionable along the sleeve relative to the shoe.

15. The apparatus of claim 13, wherein the sleeve comprises a first sleeve portion and a second sleeve portion, wherein the shoe is defined on the first sleeve portion and the sleeve collar is defined on the second sleeve portion, and wherein the first sleeve portion and the second sleeve portion are engagable with each other.

16. The apparatus of claim 15, wherein the first sleeve portion and the second sleeve portion telescopingly engage each other.

17. The apparatus of claim 13, further comprising a sleeve extension extending upwardly past the sleeve collar.

18. The apparatus of claim 17, further comprising a cap positioned over and engaging with the sleeve extension.

* * * * *